United States Patent [19]

Kasashima et al.

[11] 4,395,320

[45] Jul. 26, 1983

[54] APPARATUS FOR PRODUCING ELECTRODEPOSITED WIRES

[75] Inventors: Tatsuji Kasashima, Toyanaka; Shuji Morita, Kobe; Hiroyuki Hayami, Itami; Seiroku Ose, Higashiosaka; Yoshinori Takada, Amagasaki; Fumihiro Nozaki, Nishinomiya, all of Japan

[73] Assignee: Dainichi-Nippon Cables, Ltd., Amagasaki, Japan

[21] Appl. No.: 231,610

[22] Filed: Feb. 5, 1981

[30] Foreign Application Priority Data

Feb. 12, 1980 [JP] Japan ..... 55-16293

[51] Int. Cl.[3] ..... C25D 17/00

[52] U.S. Cl. ..... 204/206; 204/28; 204/36; 204/209

[58] Field of Search ..... 204/28, 36, 206-211

[56] References Cited

U.S. PATENT DOCUMENTS

| | | | |
|---|---|---|---|
| 1,120,191 | 12/1914 | Gibbs | 72/5 |
| 1,515,092 | 11/1924 | Cowper-Coles | 204/28 |
| 2,075,331 | 3/1937 | Antisell | 204/11 |
| 2,370,973 | 3/1945 | Lang | 205/16 |
| 2,762,763 | 9/1956 | Kenmore et al. | 204/28 |
| 3,441,494 | 4/1969 | Oshima et al. | 204/228 |
| 3,865,701 | 2/1975 | Borgmann | 204/28 |

*Primary Examiner*—Winston A. Douglas
*Assistant Examiner*—William Leader
*Attorney, Agent, or Firm*—W. G. Fasse; D. H. Kane, Jr.

[57] ABSTRACT

A method and an apparatus are disclosed for coating a metallic wire with a similar or dissimilar metallic plating layer having the desired uniform thickness and a compact metallic structure by passing the wire through electrolytic baths and through surface smoothing stations. The wire is passed through an electrolytic bath to coat the wire with a plating layer, then pressed against the peripheral surfaces of rotatable rollers to smooth the surface of the plating layer substantially over the entire periphery thereof. Subsequently the wire is coated with an electrolytic plating layer over the smoothed surface of the wire.

5 Claims, 9 Drawing Figures

APPARATUS FOR PRODUCING ELECTRODEPOSITED WIRES

BACKGROUND OF THE INVENTION

This invention relates to a method and an apparatus for coating a metallic wire with a similar or dissimilar metallic plating layer of the desired thickness by passing the wire through an electrolytic bath. More particularly, the invention provides a method and an apparatus for efficiently forming an electrolytic plating layer of compact metallic structure at a high current density.

When a thick electrolytic plating layer is to be formed on a wire, the wire usually must be passed through an electrolytic bath repeatedly a number of times to form the plating layer of predetermined thickness. If a high current density is given to the wire for the plating process, an increased amount of deposition will result per unit time, consequently reducing the number of repetitions of the electrolytic treatment.

However, with an increase in the current density, the plating layer formed around the wire becomes more rough-surfaced with marked irregularities, so that the repetition of the electrolytic treatment produces pronounced surface irregularities, failing to afford a compact plating layer.

U.S. Pat. No. 2,370,973 discloses an apparatus by which a wire coated with a compact plating layer can be produced even at a high current density. The apparatus comprises a series of electrolytic chambers provided in a straight pipe and partitioned by drawing dies. The chambers are connected to the anode of a d.c. power supply, and the drawing dies to the cathode thereof. While being passed through the pipe, the wire is electrolytically coated in one chamber, then drawn through a drawing die to smooth the plating layer, and further electrolytically coated over the smooth-surfaced plating layer in the next chamber. Thus every time the wire is electrolytically coated, the surface of the plating layer is smoothed with the drawing die.

With the apparatus described, the electrolytic plating layer formed at a high current density, even if rough-surfaced, is made smooth-surfaced by the drawing die prior to the subsequent electrolytic treatment, with the result that a wire coated with a compact plating layer can be produced at a high current density.

The apparatus nevertheless has the following drawbacks.

(1) Since the plating layer is smoothed by die drawing, the wire coated with a large amount of electrolytic deposition at a high current density is diametrically reduced every time it is smoothed. Accordingly the electrolytic step and the smoothing step must be repeated a large number of times for forming a plating layer of the desired thickness. (2) During the die-drawing smoothing step, the coated wire is subjected to tension due to the diametrical reduction. When treated for plating and smoothing repeatedly a substantial number of times, the coated wire will be loaded with severe tension, so that the number of repetitions of the above treatment is inherently limited. This imposes a limitation on the thickness of the plating layer which can be produced by a continuous process. When the apparatus is used for continuously producing a wire coated with a plating layer exceeding the limit in thickness, the apparatus requires an additional device for relieving the wire of the tension. This makes the apparatus large-sized and complex. (3) When worn, the dies must be replaced by a very cumbersome procedure, while the maintenance of the dies with the desired bore size needed leads to a reduced productivity.

Since these objections are encountered even with the apparatus of U.S. Pat. No. 2,370,973, usual electrolytic plating processes are carried out at a low current density which affords plating layers free of surface irregularities.

SUMMARY OF THE INVENTION

An object of the present invention is to provide a method and an apparatus for producing electrodeposited or rather electroplated wires with a smooth-surfaced compact electrolytic plating layer even at a high current density.

Another object of the invention is to provide a method and an apparatus for producing electrodeposited or electroplated wires in which an electrolytic plating layer formed at a high current density can be made smooth-surfaced and compacted without substantially reducing the thickness of the layer.

Still another object of the invention is to provide a method and an apparatus for continuously producing electrodeposited or electroplated wires having a plating layer of the desired thickness in which the wire material, even when repeatedly treated for electrolytic plating and for surface smoothing, will not be subjected to severe tension although no device is used for absorbing tension from the wire.

These objects can be fulfilled by coating a wire with an electrolytic plating layer, smoothing the surface of the plating layer substantially over the entire periphery thereof by bringing the surface of the coated wire into pressing contact with members each having a curved surface, and further forming an electrolytic plating layer over the smoothed surface.

The method and apparatus of the invention will be described below in greater detail with reference to the accompanying drawings.

DETAILED DESCRIPTION OF THE INVENTION

Figure 1:
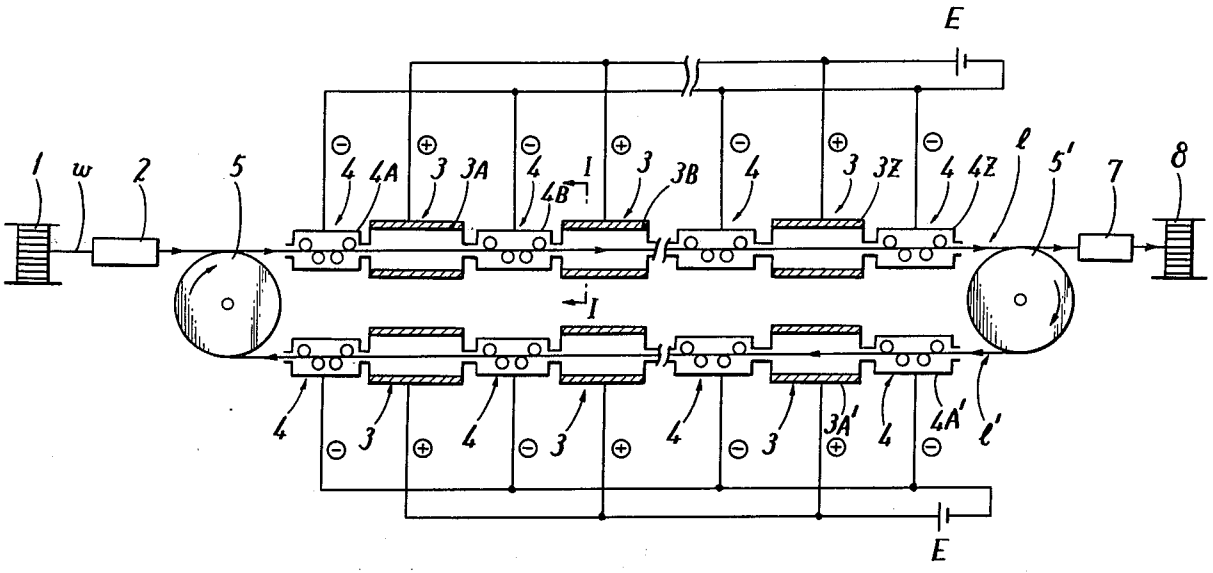
FIG. 1 is a diagram showing an apparatus embodying the invention for producing electrodeposited or electroplated wires.

FIG. 1 shows a feeder 1 for a wire w, and a pretreating bath 2 by which the surface of the wire w paid off from the feeder 1 is cleaned prior to electrolytic plating. The bath 2 comprises an alkali degreasing bath, pickling bath, water-washing bath, electropolishing bath, etc. which are usually used in preparation for metal plating. It is preferable to use an ultrasonic oscillator in combination with the electropolishing bath to electropolish the wire while giving ultrasonic waves to the electrolyte in the bath, whereby fine insoluble particles of oxides also can be removed. Indicated at 3 are electrolytic baths for coating the wire w with an electrolytic plating layer, and at 4 smoothing units by which the surface of the plating layer formed around the wire w in the baths 3 are smoothed. The electrolytic baths 3 and the smoothing units 4 are arranged alternately and each independently between a pair of driving sheaves 5 and 5' which are formed with a multiplicity of guide grooves one above another See FIG. 2 for running the wire w a number of times through the Stations 3 and 4. Indicated at 7 is a water-washing bath for cleaning the surface of the plating layer on the wire w after the completion of the electrolytic plating. A take-up drum 8 is provided for the wire.

Figure 2:
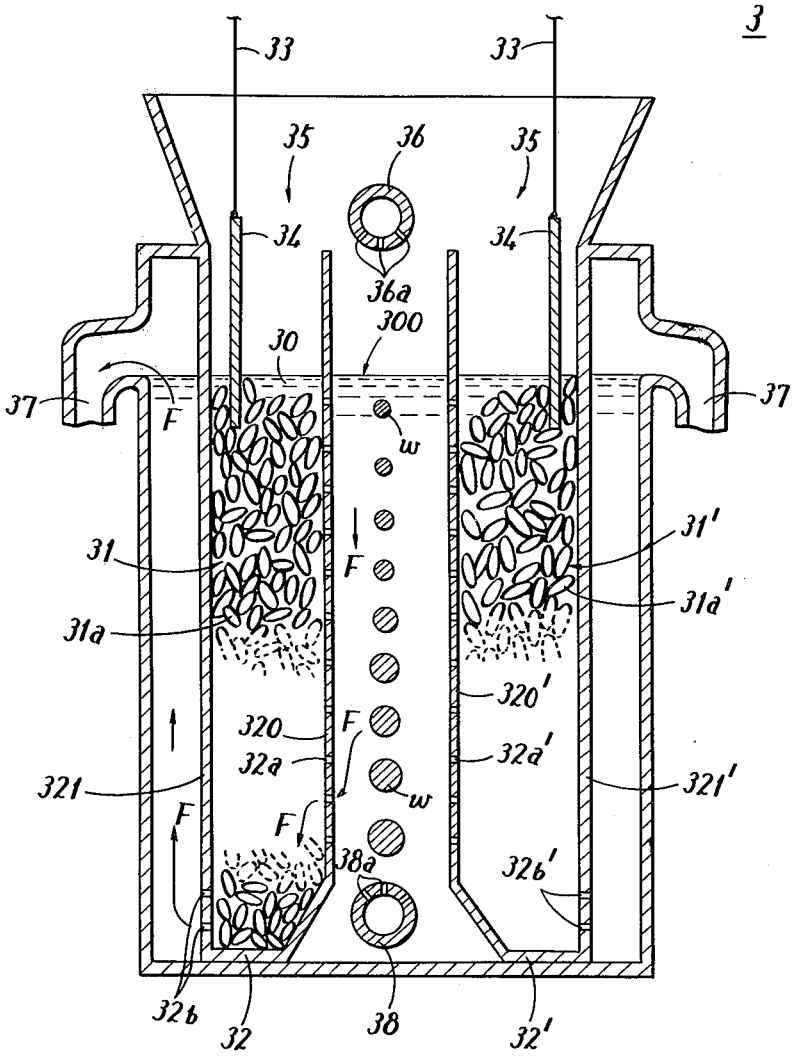
FIG. 2 is a view in section taken along the line I—I in FIG. 1 and showing an electrolytic bath useful in practicing this invention.

As seen in FIG. 2, the electrolytic bath 3 has a pair of anodes 31, 31' in its interior filled with an electrolyte 30. The wire can be passed through the space between the pair of anodes 31, 31' along paths which are arranged one above another in a row vertically of the bath so that the wire w will be coated with an electrolytic layer of uniform thickness. The anode 31 (31') comprises an assembly of small pieces or grains of plating metal **31*a* (31*a'*) so as not to remain passive even when the wire w is Subjected to a very high current density. The anodes 31, 31' are accommodated in anode baskets 32, 32', respectively. The baskets 32, 32' have side plates 320, 320' facing the wire w and formed, over the entire area thereof, with a multiplicity of perforations 32*a*, 32*a'* of such a size that the plating metal will not escape from the baskets through the perforations. The ions of the plating metal released into the electrolyte 30 are movable through the perforations 32*a*, 32*a'* onto the surface of the wire w. The other side plates 321, 321' of the baskets 32, 32' have holes 32*b*, 32*b'* close to the bottom of the bath 3 for circulating the electrolyte 30**.

The anodes 31, 31' are connected to lead plates 34 made of copper or like conductive metal and connected to cables 33 which are connected to a d.c. power supply E (see FIG. 1), whereby an anodic potential is given to the anodes 31, 31'. While the plating metal of the anodes 31, 31' is consumed with the progress of deposition of the metal plating on the wire w, the baskets 32, 32' are replenished with the metal through supply openings 35 as required. To enable the electrolyte 30 within the bath 3 to maintain a uniform cation distribution in the bath at all times and effect uniform deposition of metal ions on the outer periphery of the wire w, electrolyte 30 is supplied to the bath 3 from an electrolyte tank (not shown) through the holes **36*a* of a supply pipe 36 connected to the tank, and the electrolyte overflowing the bath 3 above the liquid level 300 is run off through a discharge pipe 37. Consequently the electrolyte 30 is circulated through the bath as indicated by arrows F. Compressed air supplied via a pipe 38 at the bottom of the bath is injected into the bath through pipe holes 38*a*** to agitate the electrolyte.

The smoothing units 4 are interposed between the electrolytic baths 3, 3, . . . thus constructed for smoothing the surface of the plating layer formed on the outer periphery of the wire w in the bath 3 as already stated.

Figure 3:
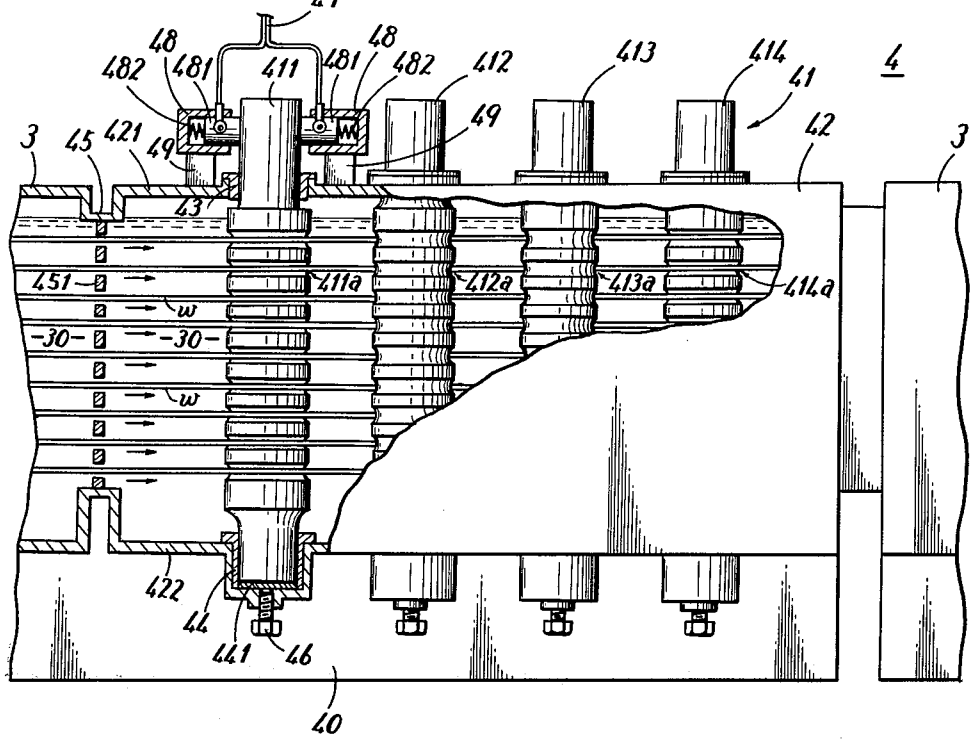
FIG. 3 is a view showing a surface smoothing unit having members or rollers with a curved surface for smoothing the coated surface of a wire.

FIG. 3 shows an embodiment of the smoothing unit 4 useful in this invention. The unit 4 comprises four rollers 41 (411, 412, 413 and 414) serving as members with a curved surface and housed in a casing 42 on a base 40. The rollers are so arranged that the surface of the plating layer of the wire w are brought into contact with the rollers and thereby pressed please see FIG. 4. Each of the rollers is rotatably supported by bearings 43, 44 provided respectively on an upper plate 421 and a lower plate 422 of the casing 42. The rotatable rollers 41 are made of suitable metal, such as the same metal as that to be deposited on the wire, or a harder metal. The rollers 411, 412, 413, 414 are formed with circumferential, grooved portions **411*a*, 412*a*, 413*a*, 414*a*, respectively for pressing the surface of the plating layer over the wire w. A multiplicity of such grooves are formed and arranged axially on the rollers. The grooved portions can be shaped suitably for pressing and smoothing the peripheral surface of the electrolytically plated wire. Preferably the grooves have a radius approximately equal to that of the plated wire. The rotatable rollers are arranged on the opposite sides of the path of travel of the wire w. As shown more specifically in FIGS. 4 and 5A to 5D, the rollers 411, 414 are disposed on one side of the path of travel of the wire w, and the rollers 412, 413 on the other side thereof, to come into contact with the wire w in the following manner. The curved surface of the groove 411*a* of the roller 411 is adapted for pressing contact with the upper half portion w1 of the left side of the wire w as shown. The curved surface of the groove 412*a* of the roller 412 is adapted for pressing contact with the lower half portion w2 of the right side of the wire w. The curved surface of the groove 413*a* of the roller 413 is adapted for pressing contact with the upper half portion w3 of the right side, and the curved surface of the groove 414*a* of the roller 414 is adapted for pressing contact with the lower half portion w4 of the left side. The bottom 441 of the bearing 44 is provided with a position adjusting bolt 46** for adjusting the position of contact of each grooved roller portion with the surface of the wire w. Since the rotatable rollers are arranged each as described above, the surface of the plated wire w is brought into contact with and pressed by the curved grooved surfaces of the rollers on its upper and lower, right and left portions while the wire w passes over the rollers, the rollers thus acting on the wire individually independently of one another. Consequently the plated wire is smoothed substantially over the entire periphery thereof without reduction in its diameter. The means for smoothing the surface of the plating layer may be a simple solid cylinder which is not rotatable, or a column of semicircular cross-section having a curved surface only where the column comes into pressing contact with the surface of the wire w. However, rollers which are freely rotatable by contact with the surface of the wire w are preferable, because the rotation produces little or no friction between the wire surface and the curved roller surface and prevents wear on the roller surface.

Thus the mechanism of this invention for smoothing the surface of the wire causes the plated wire to press and contact the surface curved members arranged along a running path for the wire and spaced apart from one another, and thereby smooth the wire surface substantially over the entire periphery thereof without substantially reducing the wire diametrically thereof. The invention therefore eliminates the likelihood that the wire will be subjected to severe tension that would occur when the wire is diametrically reduced as by die drawing for smoothing the surface.

To prevent the oxidation of the surface of the wire w in the air or deposition of impurities thereon, the case 42 of the surface smoothing unit 4 is filled with an electrolyte 30. Further to prevent the exposure of the surface of the wire w to the air, the case 42 is in communication with the electrolytic bath 3 through a channel 45, which is also filled with the electrolyte 30. The electrolyte is of the same kind as that used for the electrolytic bath, whereby the trouble is avoided that would otherwise be encountered with the plating process due to the flow of the electrolyte from the unit 4 into the bath 3. A partition 451 is installed in the channel 45 to impart increased electric resistance to the electrolyte and thereby prevent excessive electrolytic deposition on the rollers 41 when they are used as power supply rollers as will be described below.

The rotatable rollers 411 to 414 function also as power supply rollers for giving a negative potential to the wire w to render the wire w serviceable as the cathode. For the supply of power to the wire w, for example, through the roller 411, one end of the roller 411 projecting through the case upper plate 421 of the smoothing unit 4 has, in bearing contact with its outer periphery, feeders 481 made for example of carbon and connected to the negative terminal of the d.c. power supply E (FIG. 1) by a cable 47 as seen in FIG. 3. Thus the roller 411 serves as a cathode for applying a negative potential to the wire w. Each of the feeders 481 is housed in a casing 48 of insulating material supported by an arm 49 on the case upper plate 421 and is biased into contact with the end of the roller 411 by a spring or like pressing member 482 housed in the casing 48. Although not shown, the other rollers 412, 413, 414 are used as cathodes as the roller 411. The rollers, which are installed in the casing 42 of the smoothing unit 4 are immersed in the electrolyte 30 and do not produce any sparks when supplying power to the wire w and will not cause any damage to the wire surface. Further because the wire w in contact with the roller has a slightly higher potential than the roller, the plating layer formed on the wire w in the preceding electrolytic bath 3 releases a small amount of plating metal ions into the electrolyte 30 in the casing 42, with the result that these ions are deposited on the roller surface. The electrolytic plating layer thus formed on the roller has the advantage of protecting the roller surface against corrosion and the grooved roller portions from wear that would result from the contact of the grooved portions with the wire w. To positively effect suitable electrolytic deposition on the roller surface, an anode metal bar or plate connected to the positive terminal of the d.c. power supply via a suitable current controlling resistor can be installed in the casing 42 in the vicinity of the roller 41. The anode bar or plate may be made from a metal which can be electrolytically deposited on the roller and which is capable of preventing wear on the roller. To effectively form a deposition only on the grooved roller portions, it is desirable to cover the periphery of the roller except the grooved portions with an insulating material.

An electrodeposited wire is produced by the following method, using the apparatus of the above described construction.

The wire w supplied from the feeder 1 first has its surface cleaned in the pretreating bath 2 comprising baths for alkali degreasing, washing with water, electropolishing, etc., as is practiced for any usual electrolytic plating process. Subsequently the wire w is led into the casing 42 of the first smoothing unit 4A along the uppermost (or lowermost) guide groove of the turn sheave 5 which is driven. The wire w runs while being contacted with and pressed by the uppermost (or lowermost) grooved portions 411*a*, 412*a*, 413*a*, 414*a* of the rollers 411, 412, 413, 414 within the casing 42. Since the wire w has not been plated, the wire w in the smoothing unit 4A is not smoothed but is merely given a negative potential by coming into contact with the rollers 41 which are connected to the negative terminal of the d.c. power supply E. The wire w thereafter enters the first electrolytic bath 3A, in which the wire w is electrolytically coated for the first time. The electrolytic plating layer formed over the outer periphery of the wire w in the bath 3A has greater surface roughness when the current density given to the wire w is higher. The wire w running out from the bath 3A enters the second surface smoothing unit 4B, in which the plating layer has its surface smoothed substantially over the entire periphery thereof by the rotatable rollers 411, 412, 413, 414 in the manner already described without being reduced in its diameter. At the same time, these rollers apply a negative potential to the wire w. The wire is sent to the next electrolytic bath. The wire w is thereafter passed through the following electrolytic baths 3 and surface smoothing units 4 in succession. Thus the plating layer formed on the periphery of the surface of the wire w is smoothed in each bath 3 is substantially over the entire periphery thereof in the subsequent unit 4, whereby an electrolytic plating layer of increasing but uniform thickness is formed. After the wire w extending along a linel between the turn sheaves 5, 5' in one running direction has been treated for plating and smoothing in the bath 3Z and the unit 4Z, the wire w is turned by the turn sheave 5' along the uppermost (or lowermost) guide groove thereof and is passed through the surface smoothing unit 4A' along a line l' extending between the turn sheaves 5, 5' in the other running direction. The wire w having its surface smoothed in the unit 4Z on the preceding line l is smoothed again by the unit 4A', which however chiefly functions to supply power to render the wire w serviceable as a cathode (as is the case with the smoothing unit 4A on the line l). Subsequently the wire w on the line l' is treated for plating and smoothing in the same manner as on the line l, then turned by the turn sheave 5 along the guide groove immediately below the uppermost groove (or immediately above the lowermost groove), and further treated on the line l again similarly. The wire w is turned by the turn sheaves 5, 5' a specified number of times to form a plating layer of the desired thickness, is then passed through the terminal bath 3Z and unit 4Z and along the lowermost (or uppermost) groove in the turn sheave 5', has its surface cleaned in the water-washing bath 7, and is finally wound on the take-up 8. In this way, an electrodeposited wire having a plating layer of predetermined and uniform thickness is produced.

According to the invention, the wire is repeatedly plated electrolytically, and the surface of the plating layer formed around the wire is smoothed also repeatedly, so that the plating layer, even if having surface irregularities due to the electrolytic treatment at a high current density, can be made smooth-surfaced every time the wire is freshly coated. The invention therefore makes it possible to produce an electrodeposited wire efficiently with an increased amount of deposition on the wire per unit time. Further according to the invention, the surface of the plating layer coating the wire can be smoothed without substantially reducing the coated wire diametrically, with the result that the wire will not be subjected to varying tensions or to severe tension throughout the overall plating process. Accordingly an electrodeposited wire can be produced continuously with a plating layer of desired uniform thickness. Additionally because there is no need to use for the electrolytic treatment an additive which is usually used for plating to form a smooth-surfaced plating layer, the plating layer obtained is free from impurities, affording an electrodeposited wire which has a high quality both electrically and mechanically.

Figure 4:
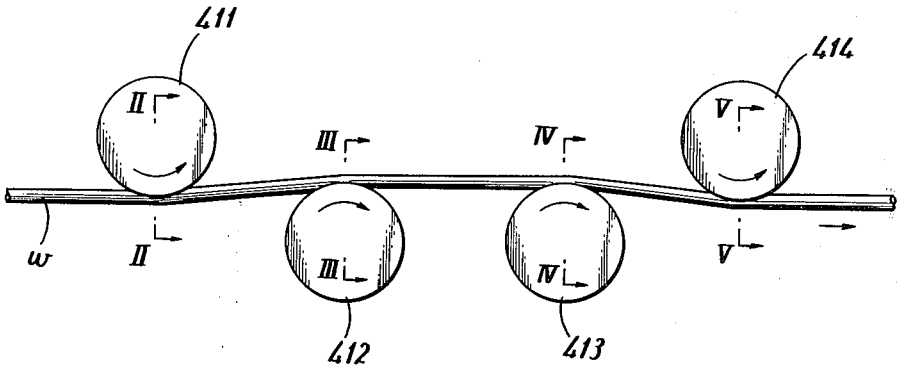
FIG. 4 is a view illustrating an arrangement for smoothing the coated surface of the wire.
Figure 5A:
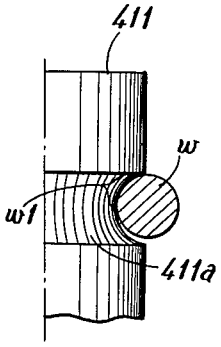
FIG. 5A is a view in section taken along the line II—II in FIG. 4.
Figure 5B:
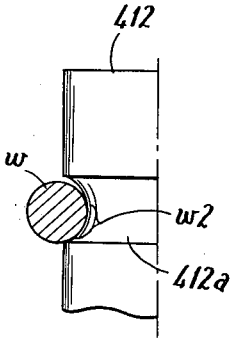
FIG. 5B is a view in section taken along the line III—III in FIG. 4.
Figure 5C:
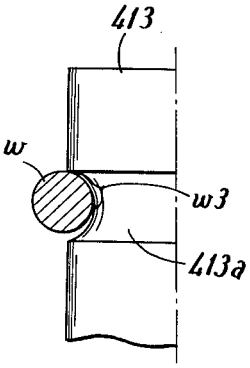
FIG. 5C is a view in section taken along the line IV—IV in FIG. 4.
Figure 5D:
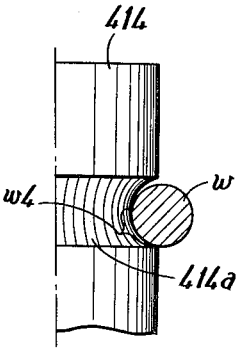
FIG. 5D is a view in section taken along the line V—V in FIG. 4.

Although the embodiment described above includes electrolytic baths and surface smoothing units which are arranged alternately between the turn sheaves 5, 5', in order to provide an electrodeposited wire of improved quality free from oxide inclusions in the plating layer due to the surface oxidation of the wire when it is turned by the turn sheaves 5, 5' in the air, a known electropolishing bath for cleaning the surface of the wire may be additionally installed between the turn sheave and the adjacent smoothing unit for treating the wire immediately after turning until it is fed to the unit, or between the smoothing unit to which the wire is fed upon being turned by the sheave and the electrolytic bath adjacent to the unit. It is more preferable to use an ultrasonic oscillator in combination with the electropolishing bath for electropolishing the wire with ultrasonic waves in the manner already described, whereby fine insoluble particles of oxides are removed from the surface of the wire. The sheaves 5, 5' may also be disposed in tanks containing an electrolyte and communicating with the smoothing units adjacent thereto. This arrangement is preferable for the prevention of surface oxidation of the wire since the overall process can be carried out in the liquid which process starts with the pretreatment of the wire supply and ending in the after-treatment of the completely plated wire. It is also possible to produce an electrodeposited wire only on a straight line without using any turn sheave. Although the rotatable rollers included in the foregoing embodiment as surface smoothing means are adapted to function also as power supply rollers to use the wire as the cathode, rollers serving solely as power supply rollers may be disposed between the electrolytic bath and the smoothing unit independently of the smoothing unit. When such power supply rollers are provided separately, rollers of ceramic materials or the like, as well as metallic rollers, are usable as the rollers for smoothing the surface of the wire. While FIGS. 3 to 5 show an arrangement of the rotatable rollers in the smoothing unit with respect to the running direction of the wire, other suitable arrangements are also useful, provided that the rollers will not draw the wire to a smaller diameter or give such tension that would break the wire.

Figure 6:
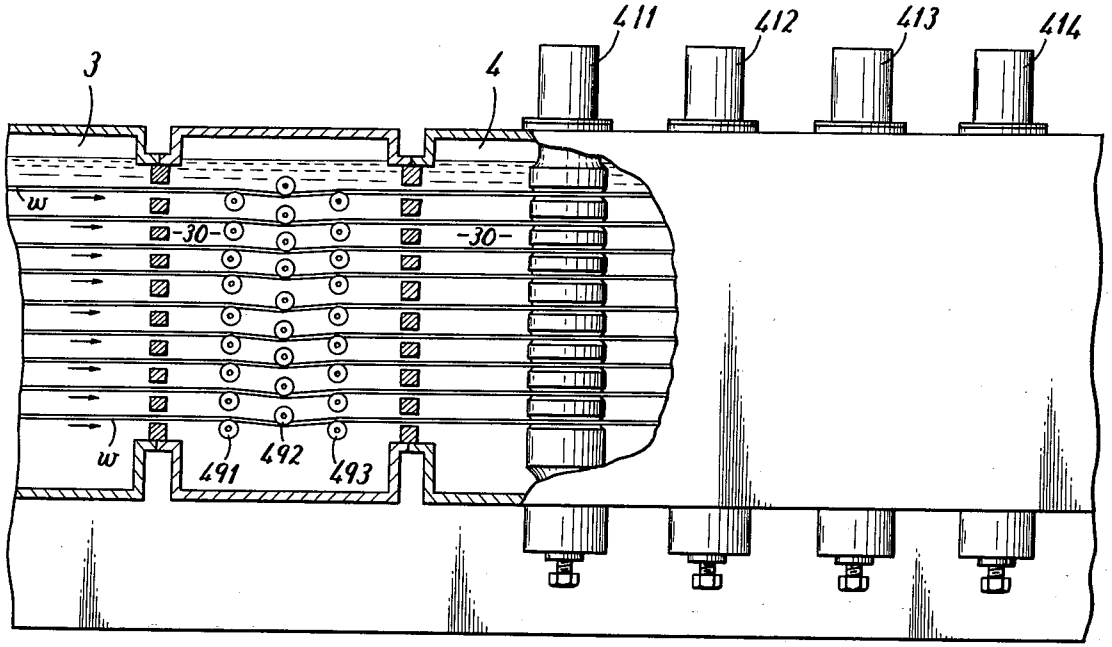
FIG. 6 is a view showing rotatable rollers serving as surface smoothing means and arranged in a different mode relative to the wire.

As shown in FIG. 6, for example, rotatable rollers 491, 492, 493 for pressing the surface of the plated wire from above and below are separately provided between the smoothing unit 4 having four rotatable rollers and shown in FIG. 3 and the electrolytic bath 3. The rollers 491 to 493 are arranged along each running path for the wire and spaced part from one another. Each roller has a circumferential grooved portion for pressing the surface of the plated wire. When the rollers 491, 492, 493 are used, the surface of the wire w having an electrolytic plating layer formed in the bath 3 is pressed by these rollers from above and below and subsequently pressed by the rollers 411, 412, 413, 414 in the mode already described. Consequently the surface of the plating layer on the wire can be smoothed over the entire periphery thereof more completely than is the case with the first embodiment.

The rollers 491, 492, 493 are located between the wire outlet end of the electrolytic bath 3 and the wire inlet end of the smoothing unit 4, between the wire outlet end of the smoothing unit 4 and the wire inlet end of the bath 3, between the sheave 5 (or 5') and the smoothing unit 4, or among the rollers 411, 412, 413, 414 in the smoothing unit 4. However, the location is preferably selected to be between the sheave 5 (or 5') and the smoothing unit 4, or among the rollers 411, 412, 413, 414, because it is desired that the smoothing unit 4 which functions also to supply power to the wire w be positioned as close as possible to the next bath for electrolytically coating the wire w, in order to prevent a voltage drop along the wire. The means for supplying power to the rollers 411 to 414 are not shown in FIG. 6.

The number of the rollers 491 to 493 for each wire running path is not limited to three; at least one pressing roller is provided above the wire, with at least one pressing roller provided below the wire. These rollers may be provided for each of the wire running paths in multiple stages, or for every other path, or at some other suitable spacing. The rollers may be disposed between each bath, or some baths which are spaced apart by a suitable distance. When the rollers 491, 492, 493 are provided for each of the wire running paths in a multistage arrangement and also between each electrolytic bath, the arrangement of the rollers 411 to 414 for pressing the wire surface need not be such as has been described with reference to FIG. 5, but these rollers may be adapted to press the wire merely on the opposite lateral sides thereof.

The advantages of the method and apparatus of this invention will be described with reference to the following example, in which a copper wire was electrolytically plated with copper to produce a copper-plated wire.

EXAMPLE

A copper wire 4.0 mm in diameter and wound on a drum was paid off by a feeder and passed through a bath containing a solution of 100 g/liter of sodium hydroxide, a water-washing bath, a bath containing a solution of 200 g/liter of sulfuric acid and a water-washing bath, in succession for pretreatment to clean the surface of the copper wire. The copper wire was then successively passed through the smoothing units and the electrolytic baths shown in FIGS. 1 to 3 and turned 60 times by a pair of driving turn sheaves of stainless steel 100 cm in diameter and each having circumferential guide grooves in 60 stages. The copper wire was run at a speed of 3 m/min. Thus the wire was repeatedly treated for electrolytic plating and for smoothing the surface of the resulting plating.

For the above operation, a smoothing unit, an electrolytic bath and a smoothing unit were arranged between the turn sheaves relative to one wire running direction, and like units and bath were similarly arranged relative the other wire running direction. The electrolytic treatment was conducted under the following conditions.

Electrolytic bath: made of stainless steel and 260 mm in width, 4500 mm in length, 1350 mm in height.

Composition of electrolyte: solution of 200 g/liter of sulfuric

Temperature of electrolyte: solution of 200 g/liter of sulfuric acid and 40 g/liter of copper Temperature of electrolyte: 50° C.

Rate of circulation of electrolyte: 150 liters/min/bath

Anode metal: small pieces of copper

Spacing between anodes: 30 mm

Current: 12500 A/bath

Smoothing unit: made of stainless steel and 250 mm in width, 650 mm in length, 1350 mm in height Freely rotatable rollers in smoothing unit: made of phosphor bronze and 70 mm in diameter, 1700 mm in length Electrolyte in smoothing unit: solution of 200 g/liter of sulfuric acid and 40 g/liter of copper Under the above conditions, the copper wire was electrolytically plated at a high current density of 30 $A/dm^2$ on the average while running between the turn sheaves, affording an electrodeposited copper wire 1100$\mu$ in plating thickness and 6.2 mm in diameter and having a compact plating layer free from impurities. The production line involved no variations in the tension on the copper wire and caused no local constriction or break to the wire. With the usual electrolytic copper plating process using copper sulfate solution as electrolyte, the treatment must be carried out at a low current density of up to 10 $A/dm^2$ for obtaining a smooth-surfaced compact plating layer, whereas the above example indicates that the copper wire can be electrolytically plated at a high current density of 30 $A/dm^2$ according to the present invention. The present method therefore achieves a very high plating efficiency.

Briefly, the present method and apparatus are useful for electrolytically plating an iron or steel wire with a dissimilar metal, such as copper, zinc or nickel, or a copper wire with a similar metal, to obtain a plating layer of the desired thickness with a high efficiency. Especially because a high-quality electrodeposited wire can be continuously produced with a plating layer of the desired thickness, the present invention is useful for producing a copper wire rod by electrolytically plating a copper wire with copper. While copper wire rods are produced generally by preparing electrolytic copper from crude copper by electrolytic refining and melting the copper for continuous casting or rolling, the invention does not require the step of preparing electrolytic copper and a complex process control. The present invention therefore has great economical advantages.

What is claimed is:

1. An apparatus for electroplating a wire to provide the wire with an electrolytic plating layer, comprising: a plurality of electroplating stations arranged in a row, each electroplating station comprising an electrolytic bath (3) for coating the wire with an electrolytic plating layer, drive means (5, 5') for passing the wire through the electrolytic baths (3) in a given travel direction, and a plurality of smoothing stations (4) each comprising means (411, 412, 413, 414) for smoothing the surface of the wire substantially over the entire periphery thereof, said smoothing stations being arranged so that at least one smoothing station is located downstream of each electroplating station (3) as viewed in said travel direction, whereby said smoothing stations and said electroplating stations are arranged in alternate sequence with each other for achieving a smooth-surfaced compact electrolytic plating layer, said surface smoothing means (411, 412, 413, 414) comprising at least four rotatable rollers arranged along and adjacent to the wire in each smoothing station, said rollers being spaced apart from one another and so positioned that substantially the entire periphery of the wire is contacted as it passes through each smoothing station, each of said rollers having a circumferential groove with a rounded groove bottom in its peripheral surface to abut on the outer peripheral surface of the wire in a compressive manner so that the surface of the wire is brought into compressing contact with the rollers each of said rotatable rollers having a rotational axis extending substantially perpendicularly to the travel direction of the wire.

2. The apparatus of claim 1, wherein said plurality of electroplating stations and said plurality of smoothing stations form a first set of stations arranged horizontally along said travel direction, said apparatus further comprising a further plurality of electroplating stations and a further plurality of smoothing stations forming a second set of stations arranged in alternate succession so that at least one smoothing station is located downstream of each electroplating station, said second set of stations being located horizontally below said first set of stations, said drive means (5, 5') forming at least one loop of wire so that the travel direction of the wire portion through the second set of stations is opposite to that of the wire portion through the first set of stations.

3. An apparatus as defined in claim 1, wherein each of the rotatable roller is connected to the negative terminal of a d.c. power supply and serves as a power supply roller for applying a negative potential to the wire.

4. An apparatus as defined in claim 3, wherein the rotatable rollers are installed in a bath filled with an electrolyte.

5. The apparatus of claim 1, wherein the circumferential groove in each of said rollers is formed with a cross-sectional curvature and diameter substantially the same as the wire.

* * * * *